US005498135A

United States Patent [19]

Stallard, III

[11] Patent Number: 5,498,135

[45] Date of Patent: Mar. 12, 1996

[54] ACTUATOR FOR A VARIABLE PITCH PROPELLER

[75] Inventor: Clinton W. Stallard, III, Hampton, Va.

[73] Assignee: Newport News Shipbuilding and Dry Dock Company, Newport News, Va.

[21] Appl. No.: 373,051

[22] Filed: Jan. 17, 1995

[51] Int. Cl.[6] ..... B63H 3/02; B63H 3/06

[52] U.S. Cl. ..... 416/155; 416/61; 416/153; 416/160; 416/162; 416/167

[58] Field of Search ..... 416/147, 153, 416/155, 160, 162, 165, 166, 167, 46, 61

[56] References Cited

U.S. PATENT DOCUMENTS

| | | | |
|---|---|---|---|
| 1,857,392 | 5/1932 | Nixon | 416/153 |
| 2,224,640 | 12/1940 | Bonawit | 416/160 |
| 3,043,374 | 7/1962 | Tourneau | 416/160 |
| 3,853,427 | 12/1974 | Holt | 416/167 |
| 3,900,274 | 8/1975 | Johnston et al. | 416/155 |
| 4,750,862 | 6/1988 | Barnes et al. | 416/160 |
| 5,174,716 | 12/1992 | Hora et al. | 416/162 |
| 5,186,608 | 2/1993 | Bagge | 416/61 |
| 5,213,472 | 5/1993 | Dumais | 416/61 |

*Primary Examiner*—Thomas E. Denion
*Assistant Examiner*—Christopher Verdier
*Attorney, Agent, or Firm*—Lalos & Keegan

[57] ABSTRACT

An actuator for varying the pitch of a plurality of propeller blades mounted on a propeller blade hub comprising an electric motor driving a drive gear, a reduction gear set driven by the drive gear and driving an externally threaded drive spool, an internally threaded pitch ring including a tangential slot, a pin received within the tangential slot and disposed on a blade hub to which the propeller blade is secured. Rotary movement of the drive gear, the reduction gear set, and the drive spool results in translational movement of the pitch ring. Translational movement of the pitch ring causes movement of the pin within the tangential slot, resulting in rotation of the propeller blade.

26 Claims, 4 Drawing Sheets

FIG. 3
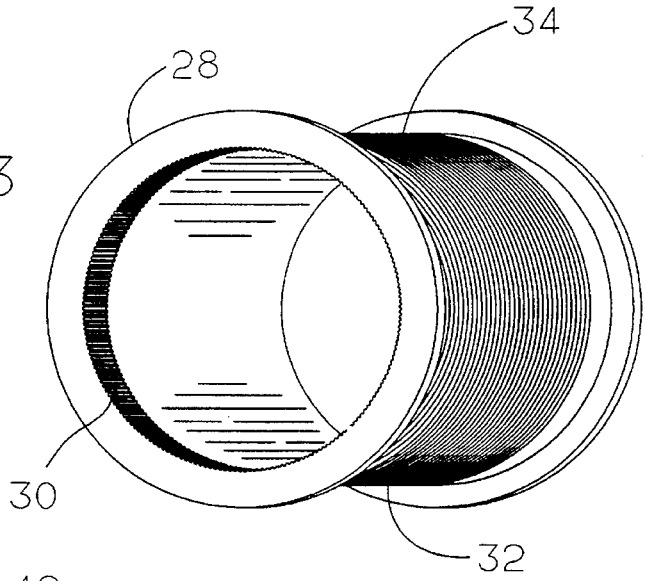
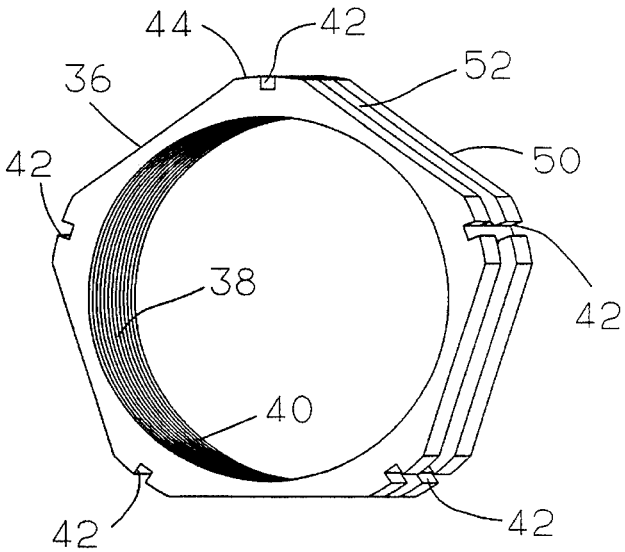
FIG. 4
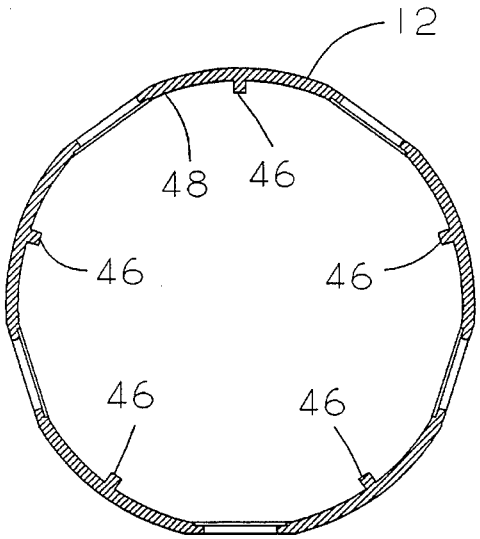
FIG. 5

ACTUATOR FOR A VARIABLE PITCH PROPELLER

FIELD OF THE INVENTION

This invention relates generally to marine propulsion systems and, more particularly, to variable pitch propeller systems and the actuating means thereof.

BACKGROUND OF THE INVENTION

In the prior art, variable pitch propeller systems typically utilize either hydraulic or mechanical activating systems. In either instance, the systems are very complicated and expensive when used for marine propulsion. Additionally, backfit of either hydraulic or mechanical variable pitch propeller technology to a ship which has a fixed pitch propeller is difficult and expensive if at all possible.

A typical hydraulic system generally includes a hydraulic pump located within the ship, actuating means disposed within the interior of the propeller hub, and hydraulic fluid pumped by the pump via rotary fluid couplings through the multiple passages in the interior of the propeller shaft to the actuating means. The major disadvantage of the hydraulic system is the difficulty of providing a porting system through the shaft. The propeller shaft must be multiply drilled along its length to accommodate the porting, rotary fluid couplings must be provided to port fluid from the dedicated hydraulic plant to the propeller shaft, and, if the propeller shaft is multipart, a sealing system for the individual ports must be included at those points where the shaft pieces are coupled. The actuating means in the propeller hub includes a hydraulic ram and blade actuating mechanisms. These parts require precision fitting since the hydraulic forces on each side of the ram head must be balanced to provide the correct propeller pitch. Precision fitting of these parts can be difficult to achieve due to the large size of these parts in the propeller hub.

A mechanical variable pitch control mechanism requires a mechanical actuating rod extending the length of the shaft through a single hole in the center of the propeller shaft to the blade rotating mechanism. Although providing the single hole in the shaft for the mechanical system is preferable to the complicated porting system required of the hydraulic system, there are disadvantages here as well. To permit access between the actuating rod and the actuating mechanism located within the ship, the mechanical actuating rod must be longer than the propeller shaft to enable it to protrude forwardly from the reduction gear casing. Furthermore, mechanical systems are typically not utilized on direct drive ships such as a diesel, since there is no point of access to the end of the propeller shaft.

SUMMARY OF THE INVENTION

The purpose of this invention is to provide an improved actuating mechanism for a plurality of variable pitch propeller blades which is less expensive to manufacture and install than the present system, can be installed on existing ships currently fitted with fixed pitch propellers, and is suitable for use with either direct drive or reduction gear drive propulsion systems.

The actuator of the present invention is contained within the propeller hub and is comprised generally of an electric motor driving a drive gear, a means for transforming rotary movement of the drive gear to translational movement, and a means for converting the translational movement of the transforming means to rotational movement of each propeller blade. Preferably, the electric motor comprises a stator fixedly mounted to the interior of the actuator housing (the propeller hub) and a rotor rotatable about the center axis of the actuator housing relative to the stator. The drive gear, mounted on the rotor shaft and located at the housing center axis, drives a reduction gear set. The transforming means includes a drive spool driven by the reduction gear set and externally threaded. An internally threaded pitch ring is provided driven by the drive spool. Thus, rotation of the drive spool causes transverse movement of the pitch ring via the coacting threads of the drive spool and pitch ring. The pitch ring also includes on the outer surface thereof a plurality of tangential flats, each flat having a tangential slot disposed thereon. The converting means comprises the pitch ring slot and a pin disposed within the slot and secured to and protruding from the rotatable propeller blade hub. As the pitch ring is moved transversely, the pin is caused to move within the slot, thereby causing rotation of the blade.

BRIEF DESCRIPTION OF THE DRAWINGS

FIG. 3 is a perspective view of the drive spool of the embodiment shown in FIGS. 1 and 2.

FIG. 4 is a perspective view of the pitch ring of the embodiment shown in FIGS. 1–3.

FIG. 5 is a cross-sectional view of the housing of the embodiment shown in FIGS. 1–4.

DESCRIPTION OF THE PREFERRED EMBODIMENTS

Referring to the illustration of the present invention shown in FIGS. 1–5, the actuator 10 is shown disposed within an actuator housing 12 of a water vessel. Spaced circumferentially about housing 12 is a plurality of propeller blades 14.

Figure 1:
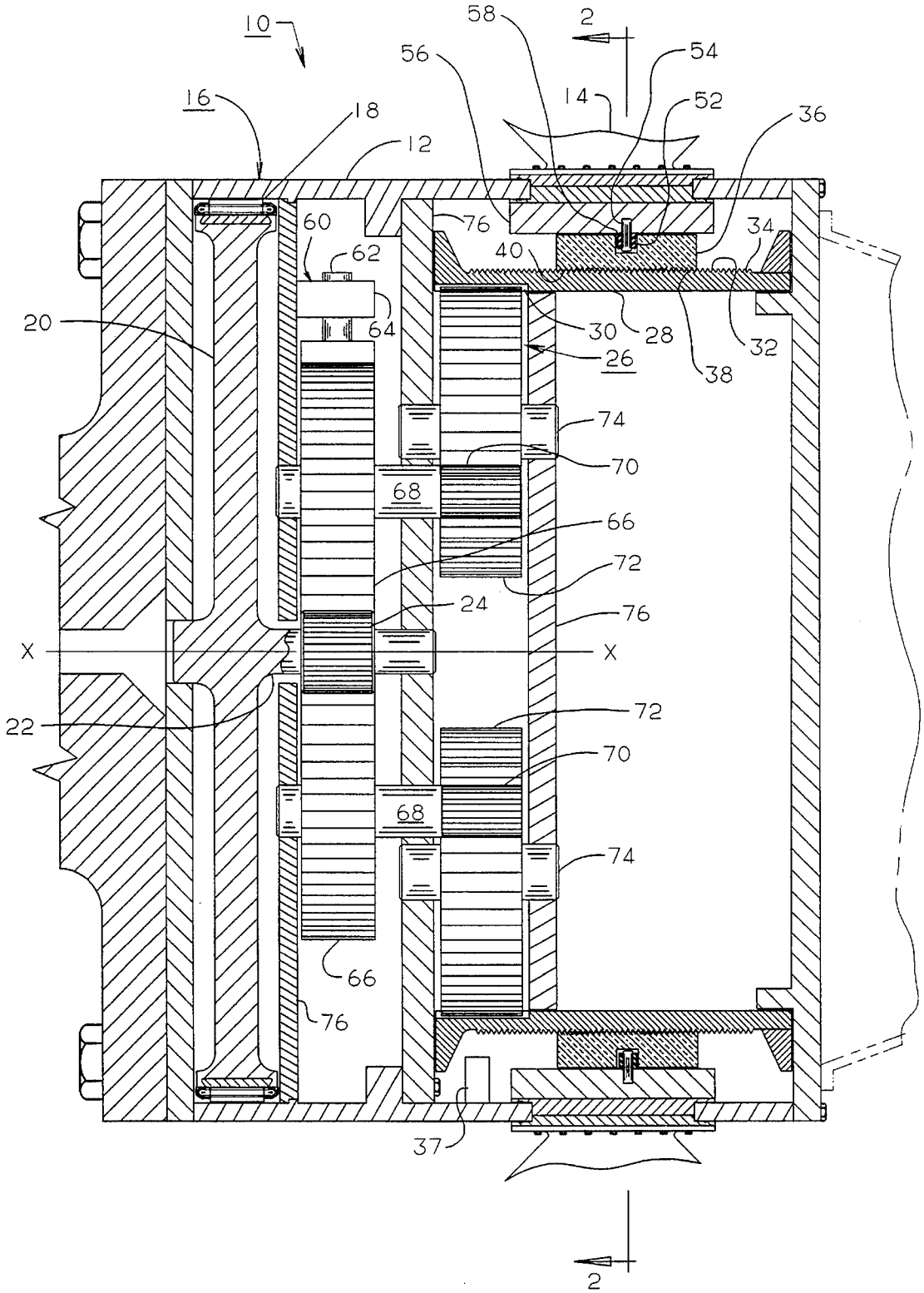
FIG. 1 is a cross-sectional side view of the preferred embodiment of the present invention.

As seen in FIG. 1, an electric motor 16 is disposed within housing 12. Electric motor 16 generally includes a stator 18 fixedly mounted to the inner surface of the housing and a rotor 20 rotatable about the center axis X—X of housing 12 relative to stator 18 to drive an output shaft 22. Preferably, the diameter of the rotor is as large as practicable to provide maximum torque for minimum weight and volume. Additionally, the electric motor must be reversible to permit blades 14 to rotate in a clockwise or counterclockwise direction relative to the housing.

Figure 2:
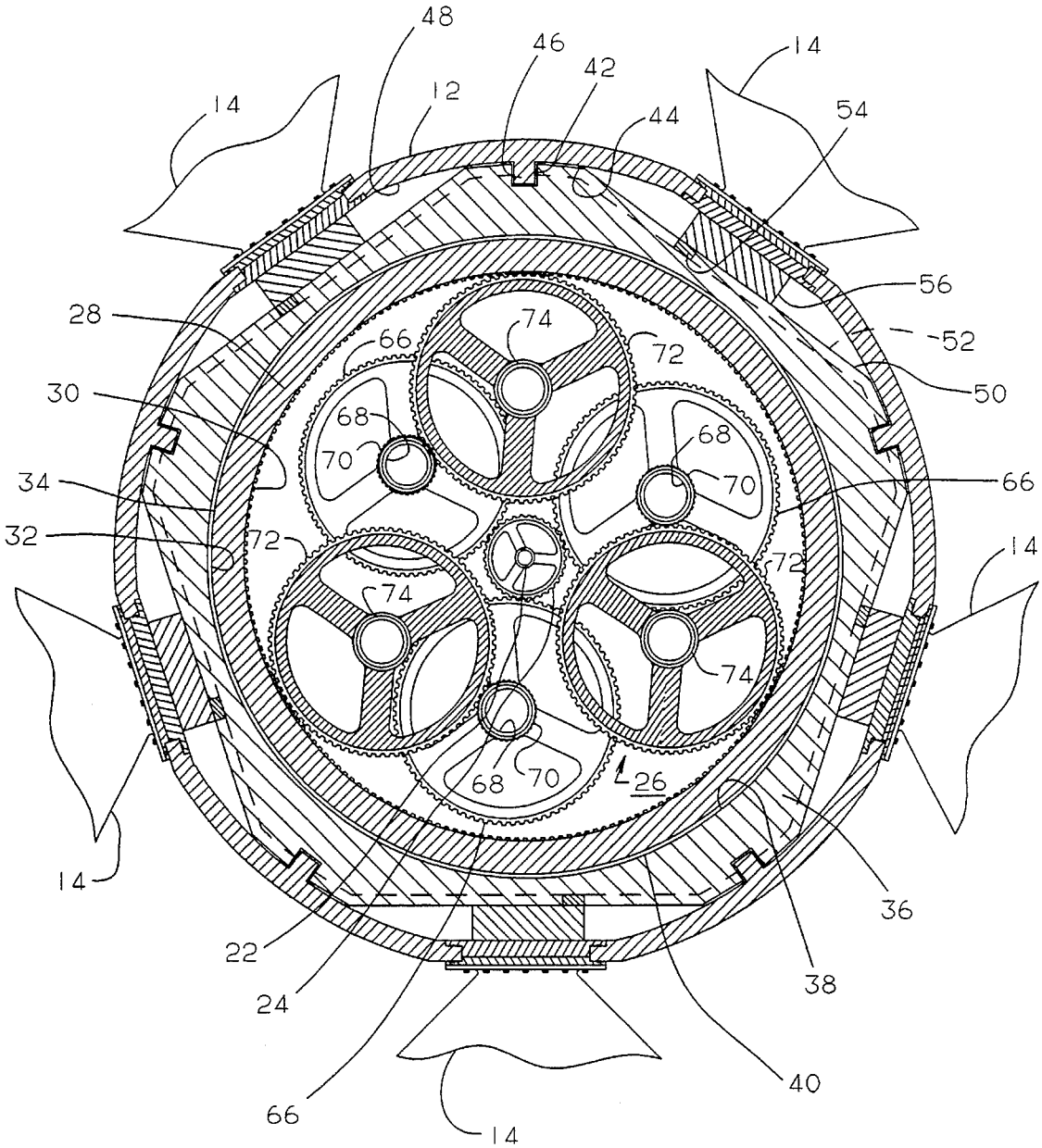
FIG. 2 is a cross-sectional end view of the embodiment of FIG. 1 taken along line 2—2 of FIG. 1.

Mounted on output shaft 22 of electric motor 16 is a drive gear 24. Drive gear 24 drives a reduction gear set 26 which, in turn, drives a drive spool 28. As best seen in FIG. 2, drive gear 24, reduction gear set 26 and the inner surface 30 of drive spool 28 employ a conventional tooth pattern such as a worm, spur or other pattern. The outer surface 32 of drive spool 28 has an external thread 34. Driven by drive spool 28 is a pitch ring 36 including an internal surface 38 having an internal thread 40 cooperating with external thread 34 of drive spool 28. Preferably, external thread 34 and internal thread 40 are of an acme or buttress thread style; however, any appropriate thread may be used. It can be seen that the coacting threads 34 and 40 transform the rotary movement of drive gear 24, reduction gear set 26 and drive spool 28 to translational movement of pitch ring 36.

As best seen in FIGS. 4 and 5, pitch ring 36 includes a plurality of axial locating grooves 42 disposed on an outer surface 44 thereof, and housing 12 includes a plurality of bosses 46 projecting radially inwardly from an inner surface 48 of housing 12. When assembled, bosses 46 are received within grooves 42. Thus, pitch ring 36 is secured relative to housing 12 so that as drive spool 28 rotates, pitch ring 36 moves axially relative to drive spool 28 rather than rotating therewith, resulting in translational movement of pitch ring 36 relative to housing 12.

Referring again to FIG. 4, it can be seen that pitch ring 36 is generally polygonal and includes a plurality of tangential flats 50 on pitch ring outer surface 44. The number of flats provided corresponds to the number of propeller blades utilized. Disposed on each flat 50 is a tangential slot 52. Slot 52 is adapted to receive an offset actuating pin 54 disposed on a blade hub 56 of propeller blade 14. As best seen in FIG. 1, pin 54 includes roller bearings 58 or the like to facilitate free movement of pin 54 within slot 52. As pitch ring 36 moves forward and aft relative to drive spool 28, pin 54 is repositioned within slot 52, causing blade 14 to rotate. Preferably, blade 14 can rotate a minimum of 90° and a maximum of at least 130°.

To prevent rotation of the blade when the blade actuating mechanism is not in use, a gear locking device 60 is employed. One example of such a locking device is shown in FIG. 1 and includes an electrically released normally engaged brake including a mechanical lock 62 operated by a solenoid 64. Any other appropriate mechanism may be used. As shown in FIG. 1, gear locking device 60 prevents reduction gear set 26 from moving once the desired pitch setting of the blade is set, thus ensuring that the pitch setting is not affected by torques or vibration generated by operation of the propeller.

Figure 6:
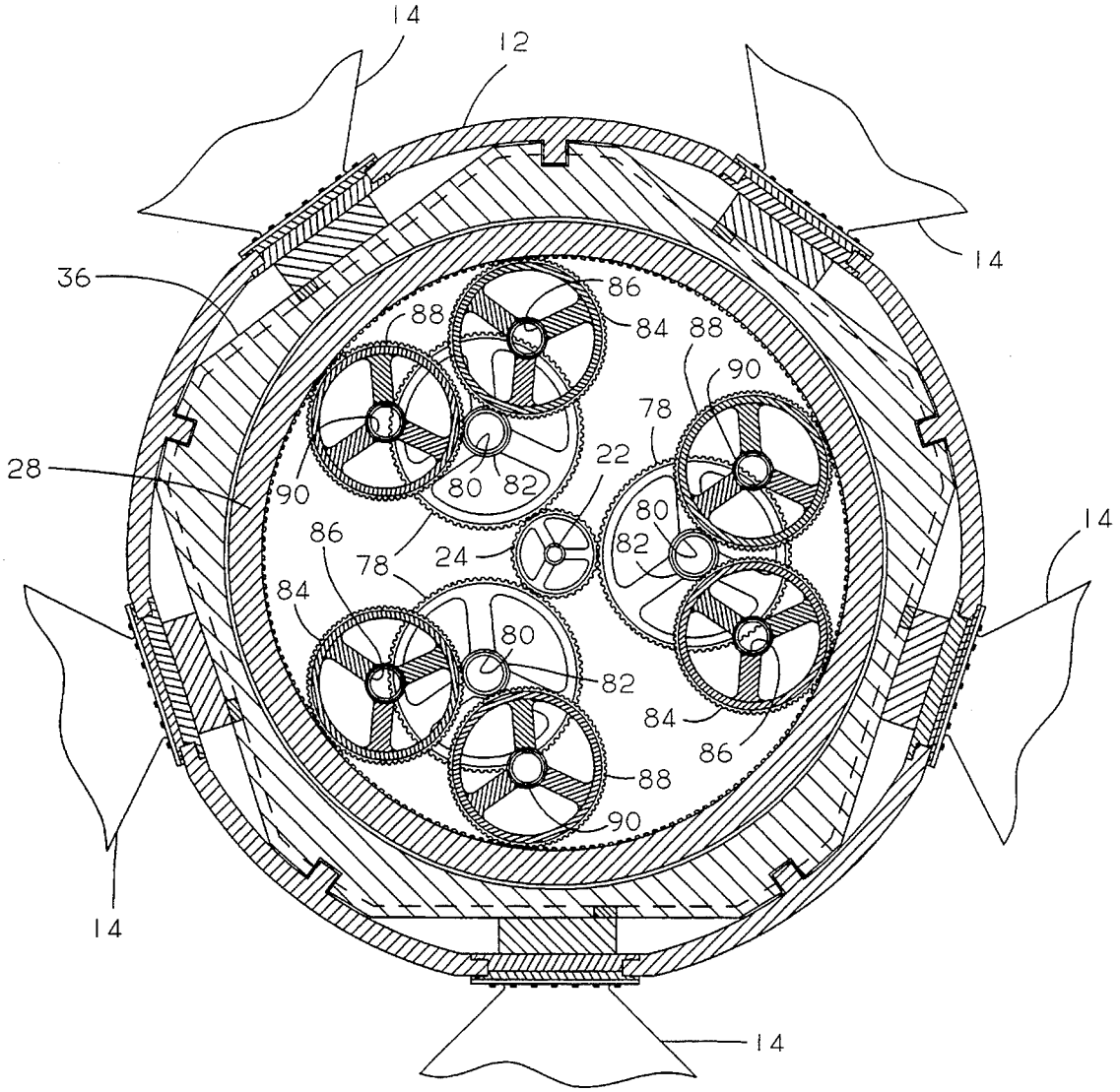
FIG. 6 is a cross-sectional end view similar to FIG. 2 of an alternate embodiment of the present invention.

Reduction gear set 26 may be either a single stage or a compound reduction gear set. In either event, the reduction gear set must be of a sufficient step-down ratio to permit electric motor 16 to provide the required torque to the propeller blades to allow them to be easily rotated at full propulsion plant output power. An example of a compound reduction gear set is shown in FIGS. 1 and 2, in which drive gear 24 drives a plurality of first gears 66 mounted to a plurality of first shafts 68. Also mounted to each first shaft 68 is one of a plurality of second gears 70. Each second gear 70 drives one of a plurality of third gears 72 mounted to one of a plurality of second shafts 74. Each third gear 72 cooperates with and drives drive spool 28. As best seen in FIG. 1, shafts 68 and 74 are supported by various support plates 76 as necessary. In an alternate embodiment of a compound reduction gear set as shown in FIG. 6, a plurality of first gears 78 is mounted to a plurality of first shafts 80 and driven by drive gear 24. Also mounted to each of the plurality of first shafts 80 is one of a plurality of second gears 82. Each second gear 82 drives one of a plurality of third gears 84 mounted to one of a plurality of second shafts 86 and one of a plurality of fourth gears 88 mounted to one of a plurality of third shafts 90. Each third gear 84 and fourth gear 88 cooperates with and drives drive spool 28. As in the first embodiment, shafts 80, 86 and 90 are supported by various end plates (not shown) as required.

Electric motor 16 is powered by cables passing through a central bore in the propeller shaft from the housing to a slip or induction ring assembly located on a low stress area of the inboard side of the propeller shaft. The propeller shaft and housing are sealed by o-rings or other sealing means so that water may not enter the central bore of the propeller shaft or the actuator housing. The cables are retained within the bore by packing the bore with an inert filler such as sand to prevent motion of the cables relative to the shaft bore surface. The motor is operated by a motor controller of conventional design which has a jog and reversing capability and which can be operated from several remote positions such as the ship bridge and engineering station.

In operation, the ship operator sends a signal from a remote station to the motor controller of motor 16, whereupon motor 16 is energized. Electric motor 16 rotates in the desired direction to rotate drive gear 24 and reduction gear set 26, which in turn causes rotation of drive spool 28 in a clockwise or counterclockwise direction. Rotation of drive spool 28 results in lateral translation of pitch ring 36 in a fore or aft direction. The lateral translation of pitch ring 36 causes movement of pin 54 within slot 52, resulting in rotation of the blade hub 56 and thus rotation of the propeller blade attached thereto. The pitch of the propeller blade is thus changed, allowing an efficient match of the pitch of the propeller assembly to the ship as its speed and loading conditions change. Electric motor 16 will continue to be energized until the desired pitch setting is achieved, whereupon the motor will be deenergized and the locking device engaged.

The pitch position of the blades is preferably determined by a linear variable displacement transducer 37 or other position measuring device mounted internal to or made integral with the housing. Such a device preferably is capable of determining and transmitting to the operator the position of pitch ring 36 and thus the propeller pitch setting.

A typical embodiment of a propeller on which the actuator of the present invention might be used is a variable pitch propeller with five blades powered by a 30,000 horsepower propulsion motor. The actuator for such a propeller might have, for instance, the following gear ratios:

Drive spool 28 to gear 72—4:1

Gear 72 to gear 70—5:1

Gear 70 to gear 66—1:1

Gear 66 to drive gear 24—4:1

Pin 78 to blade 14—2:1

Translational movement of pitch ring 36 to rotational movement of drive spool 28—10:1

Thus, the total gear ratio provided by this embodiment is 1600:1. To rotate the blades, a 20 horsepower electric motor may be required. It is preferred that a sufficiently large motor be used to provide a factor of safety of 2.5.

From the foregoing detailed description, it will be evident that there are a number of changes, adaptations and modifications of the present invention which come within the province of those having ordinary skill in the art to which the aforementioned invention pertains. However, it is intended that all such variations not departing from the spirit of the invention be considered as within the scope thereof, limited solely by the appended claims.

I claim:

1. An actuator for a plurality of variable pitch propeller blades mounted on a housing having a center axis, the actuator comprising:

an electric motor for driving a drive gear;

means for transforming rotary movement of the drive gear to translational movement of a pitch ring comprising a reduction gear set rotatably driven by the drive gear, a drive spool rotatably driven by the reduction gear set, and the pitch ring located by the housing and driven by the drive spool, wherein the drive spool is externally threaded and the pitch ring is internally threaded such that rotation of the drive spool causes translational movement of the pitch ring; and means for converting the translational movement of the transforming means to rotational movement of each of the plurality of propeller blades.

2. An actuator according to claim 1, wherein the housing includes locating means for positioning the pitch ring relative to the housing.

3. An actuator according to claim 2, wherein the locating means comprises a plurality of axial locating grooves disposed circumferentially about the outside surface of the pitch ring and a plurality of axial bosses radially projecting inwardly from the inner surface of the housing, the bosses being received within the locating grooves.

4. An actuator according to claim 1, wherein the reduction gear set comprises a first gear disposed on a first shaft and driven by the drive gear, a second gear disposed on the first shaft and rotating with the first gear, and a third gear disposed on a second shaft and driven by the second gear, wherein the third gear cooperates with and drives the drive spool.

5. An actuator according to claim 4, further comprising a fourth gear disposed on a third shaft and driven by the second gear, wherein both the third and fourth gears cooperate with and drive the drive spool.

6. An actuator according to claim 1, wherein the pitch ring includes a plurality of tangential flats disposed circumferentially about the outside surface of the pitch ring, each of the plurality of flats including a tangentially disposed slot.

7. An actuator according to claim 6, wherein each propeller blade is mounted to one of a plurality of rotatable propeller blade hubs supported by the housing, each of the rotatable propeller blade hubs including an actuating pin received in one of the tangentially disposed slots of the pitch ring, the converting means comprising the rotatable hub actuating pins and the pitch ring tangentially disposed slots, whereupon translational movement of the pitch ring with the rotatable hub actuating pins disposed within the pitch ring slots rotates the propeller blades.

8. An actuator according to claim 7, further comprising bearing means mounted on each actuating pin for facilitating free movement of each actuating pin within one of the pitch ring slots.

9. An actuator according to claim 7, wherein each propeller blade rotates at least 90°.

10. An actuator according to claim 7, wherein each propeller blade can rotate a minimum of 90° and a maximum of 130°.

11. An actuator according to claim 7, wherein each propeller blade can rotate no more than 130°.

12. An actuator according to claim 1, wherein each propeller blade rotates at least 90°.

13. An actuator according to claim 1, wherein each propeller blade can rotate a minimum of 90° and a maximum of 130°.

14. An actuator according to claim 1, wherein each propeller blade can rotate no more than 130°.

15. An actuator according to claim 1, wherein the electric motor comprises a stator fixedly mounted to the actuator housing and a rotor rotatable about the housing center axis, the rotor driving an output shaft on which the drive gear is mounted.

16. An actuator according to claim 15, wherein the electric motor is reversible.

17. An actuator according to claim 1, further comprising means for locking the reduction gear set in place to prevent rotation thereof.

18. An actuator according to claim 17, wherein the locking means comprises an electrically released normally engaged brake.

19. An actuator according to claim 18, wherein the brake comprises a mechanical lock operated by a solenoid.

20. An actuator according to claim 1, further comprising means for determining the position of the propeller blades.

21. An actuator according to claim 20, wherein the determining means is mounted to the housing.

22. An actuator according to claim 21, wherein the determining means relays the position of the pitch ring from which the pitch of the blades may be determined.

23. An actuator according to claim 22, wherein the determining means comprises a linear variable displacement transducer.

24. An actuator according to claim 20, wherein the determining means is made integral with the housing.

25. An actuator according to claim 24, wherein the determining means relays the position of the pitch ring from which the pitch of the blades may be determined.

26. An actuator according to claim 25, wherein the determining means comprises a linear variable displacement transducer.

* * * * *